US005771674A

United States Patent [19]

Smith et al.

[11] Patent Number: 5,771,674

[45] Date of Patent: Jun. 30, 1998

[54] PROCESS AND APPARATUS FOR CRIMPING FIBERS

[76] Inventors: W. Novis Smith, 412 S. Perth St., Philadelphia, Pa. 19147; Toby Burnham, 1480 Pumphrey Ave., Auburn, Ala. 36830

[21] Appl. No.: 654,333

[22] Filed: May 28, 1996

[51] Int. Cl.[6] ..... D01H 5/00

[52] U.S. Cl. ..... 57/284; 28/249; 28/258; 28/279; 57/290

[58] Field of Search ..... 57/246, 239, 254, 57/284, 290; 28/247, 249, 252, 258, 278, 279, 282

[56] References Cited

U.S. PATENT DOCUMENTS

| | | | |
|---|---|---|---|
| 2,623,266 | 12/1952 | Hemmi | 28/279 |
| 2,636,250 | 4/1953 | Hemmi | 28/279 |
| 3,908,410 | 9/1975 | Umehara et al. | 28/247 |
| 4,241,478 | 12/1980 | Nurk | 28/278 |
| 4,676,274 | 6/1987 | McCullough et al. | 28/278 |
| 4,837,076 | 6/1989 | McCullough et al. | 428/224 |
| 4,977,654 | 12/1990 | McCullough | 28/278 |
| 5,356,707 | 10/1994 | McCullough et al. | 428/367 |

FOREIGN PATENT DOCUMENTS

| | | | |
|---|---|---|---|
| 661613 | 7/1965 | Belgium | 28/252 |
| 2681341 | 3/1993 | France | 28/247 |
| 2681342 | 3/1993 | France | 28/247 |

*Primary Examiner*—William Stryjewski
*Attorney, Agent, or Firm*—John Lezdey

[57] ABSTRACT

An apparatus is provided for crimping and heat setting a filament or a tow of filaments and to provide fine filaments. The apparatus has at least one heating zone with means for heating a filament or a tow of filaments in an inert and/or oxidizing atmosphere. In the heating zone is a pair of horizontally movable mating conveying means having a multiplicity of protrusions for imparting a crimp to said filament or tow.

10 Claims, 2 Drawing Sheets

PROCESS AND APPARATUS FOR CRIMPING FIBERS

FIELD OF THE INVENTION

The present invention relates to an apparatus and method for providing smaller diameter fibers with non-stressed crimps. More particularly, the invention relates to a method and apparatus for providing sinusoidal configuration polymeric fibers by heat treating or irradiating without subjecting the fibers to excessive stress or tension either before or during crimping. The apparatus is especially useful to produce crimped fiber from large sized tows.

BACKGROUND OF THE INVENTION

The prior art discloses the manufacture of non-linear carbonaceous fibers having a reversible deflection ratio of greater than 1.2:1 and derived from polymer compositions such as polyacrylonitrile (PAN). The polymeric material is spun into fibers and can be collected into multifiber assemblies, such as fiber tows containing more than 1000 (1K) individual fibers, that are thereafter oxidatively stabilized. Small tows generally contain from about 1K to 20K fibers, heavy tows contain more than 40K. The fibers or fiber tows can thereafter be formed into a knitted fabric which is then heat treated in a non-oxidizing atmosphere while the fibers are in a relaxed and unstressed condition. Heat treating the fibers increases the carbon content to form carbonaceous fibers which are substantially heat set. The fabric can then be deknitted to form non-linear fiber tows which can then be further processed, as by carding, to form a wool like fluff.

Non-linear carbonaceous fibers and the process of manufacture is disclosed in U.S. Pat. No. 4,837,076 of McCullough et al. These prior non-linear carbonaceous fibers have the disadvantage of difficult processability in forming spun yarns in that they cannot easily be formed by slivers (a continuous strand of loosely assembled fibers without twist) after carding and in subsequent drawing operations without a substantial amount of fiber breakage due to the relatively lower elongatability of the fiber. Moreover, such fibers are difficult to spin into fine yarn especially when they are blended with other synthetic or natural fibers due to the nature of their crimps. Although the crimps in the fiber are necessary for good processability, the relatively large amplitude and low frequency of the crimps in the prior art fibers causes excessive fiber breakage during carding and drawing. In addition, the prior art fibers exhibit poor cohesiveness and sacrifice elongatability to improve tenacity.

Stuffer box crimping and traditional gear crimping, which is commonly used in fiber processing, results in sharp V-type bends in the fiber wherein the outer portion of the fiber bend is subject to severe stress and the underside of the bend is subject to severe compression. These sharp bends therefore provide severely weakened portions in the fiber by causing cracking (on the outer fiber portion), creasing (on the inner fiber portion), or fibrillation. Accordingly, any defective portions of the fiber, when subjected to a bending strain, will lead to breakage at the defective portions of the fiber, especially with fibers that exhibit a greater rigidity or stiffness such as will occur in fibers that are heat treated at a higher temperature, resulting in an increase in the carbon content of the fiber.

In an article by Hall et al entitled, "Effects of Excessive Crimp on the Textile Strength and Compressive Properties of Polyester Fibers," in Journal of Applied Polymer Science, Vol 15 pp. 1539–2544 (1971), the authors describe the detrimental effects of forming sharp crimps in polyester fibers as well as other man made fibers. The authors report that excessive crimping, such as is found in V-type crimps, leads to surface damage of the fiber and a reduction in tenacity and other physical properties, e.g., elongatability which leads to fiber breakage when the fiber is placed under tension.

U.S. Pat. Nos. 4,977,654 and 5,356,707 to McCullough et al, which are herein incorporated by reference, disclose apparatuses for crimping and heat setting a fiber or tow wherein the fibers or tow are crimped or placed into a non-linear configuration outside of the heating zone. The result of crimping outside of the heating zone is that the fibers or tow are insufficiently softened so as to result in stress or strain that affects the condition of the final carbonaceous product. Stress and strains result in fibers with voids so that there is fiber breakage during processing.

The term "reversible deflection ratio" as used herein generally applies to a helical or sinusoidal compression spring. Particular reference is made to the publication, "Mechanical Design-Theory and Practice", MacMillan Publ. Co., 1975, pp. 719 to 748: particularly Section 14-2, pages 721 to 724.

The term "permanent" or "irreversibly heat set" used herein applies to nonlinear fibers which have been heat treated under the conditions as set forth hereinafter until they possess a degree of resiliency and flexibility such that the fibers, when stretched and placed under tension to a substantially linear shape, but without exceeding the tensile strength of the fibers, will revert substantially to their original non-linear shape once the tension on the fibers is released. The foregoing terms also imply that the fibers are capable of being stretched and released over many cycles without breaking the fibers.

The term "fiber structures" herein applies to a multiplicity of filaments that are in the form of a yarn, a wool like fluff or batting, nonwoven fibers that are assembled into a web or felt, a knitted or woven cloth or fabric, or the like.

The term "crimp" as used herein refers to the waviness or nonlinearity of the fiber or fiber tow, as defined in "Man Made Fiber and Textile Dictionary" by Celanese Corporation. The term crimp includes different nonlinear configurations such as, for example, sinusoidal, coil like, and the like. In accordance with a further development of the present invention, the crimp can be a combination of two or more geometric or nongeometric configurations where one crimp is superimposed upon another crimp. For example, a complex crimp can be one in which a lower frequency crimp is superimposed upon a higher frequency crimp.

SUMMARY OF THE INVENTION

According to one embodiment of the invention there is provided an apparatus for preparing non-linear oxidized and/or carbonaceous acrylic filaments or tow of filaments.

According to another embodiment of the invention there is provided methods for preparing non-linear oxidized polyacrylonitrile fibers and/or non-linear carbonaceous acrylic fibers.

More particularly, an apparatus is provided for crimping and heat setting a filament or tow of filaments of acrylic fibers. The apparatus comprises at least one heating zone and means for heating the filament or tow in an oxidizing or inert atmosphere while passing therethrough. The filament or tow is passed through the heating zone by means of a pair of horizontally movable mating conveying means having a plurality of protrusions for imparting crimps to the filament while passing through the heating zone.

Advantageously, the protrusions comprise self-aligning bars which hold the filament or tow in a non-linear manner while the filament or tow is heat set. The bars may be of the same configuration to provide symmetrical crimps or may be of different diameters and configurations to provide non-symmetrical or complex crimps.

One heating zone may comprise a fiber oxidation and another heating zone may comprise means for substantially irreversibly heat setting the filament or tow in an inert atmosphere.

According to one method of the invention, a filament or tow is passed through the apparatus either to form a non-linear oxidized acrylic fiber or a substantially permanently set non-linear carbonaceous acrylic fiber.

It is therefore a primary object of the invention to provide an apparatus for preparing non-linear oxidized or carbonaceous filaments or tow of filaments.

It is a further object of the invention to provide an apparatus which can prepare crimped carbonaceous acrylic fibers having smaller fiber diameters.

It is another object of the invention to provide a process for preparing crimped oxidized or carbonaceous acrylic fibers.

Other objects and a fuller understanding of the invention will be had by referring to the following description and claims of a preferred embodiment, taken in conjunction with the accompanying drawings, wherein like reference characters refer to similar parts throughout the several views.

DESCRIPTION OF THE PREFERRED EMBODIMENTS OF THE INVENTION

Figure 1:
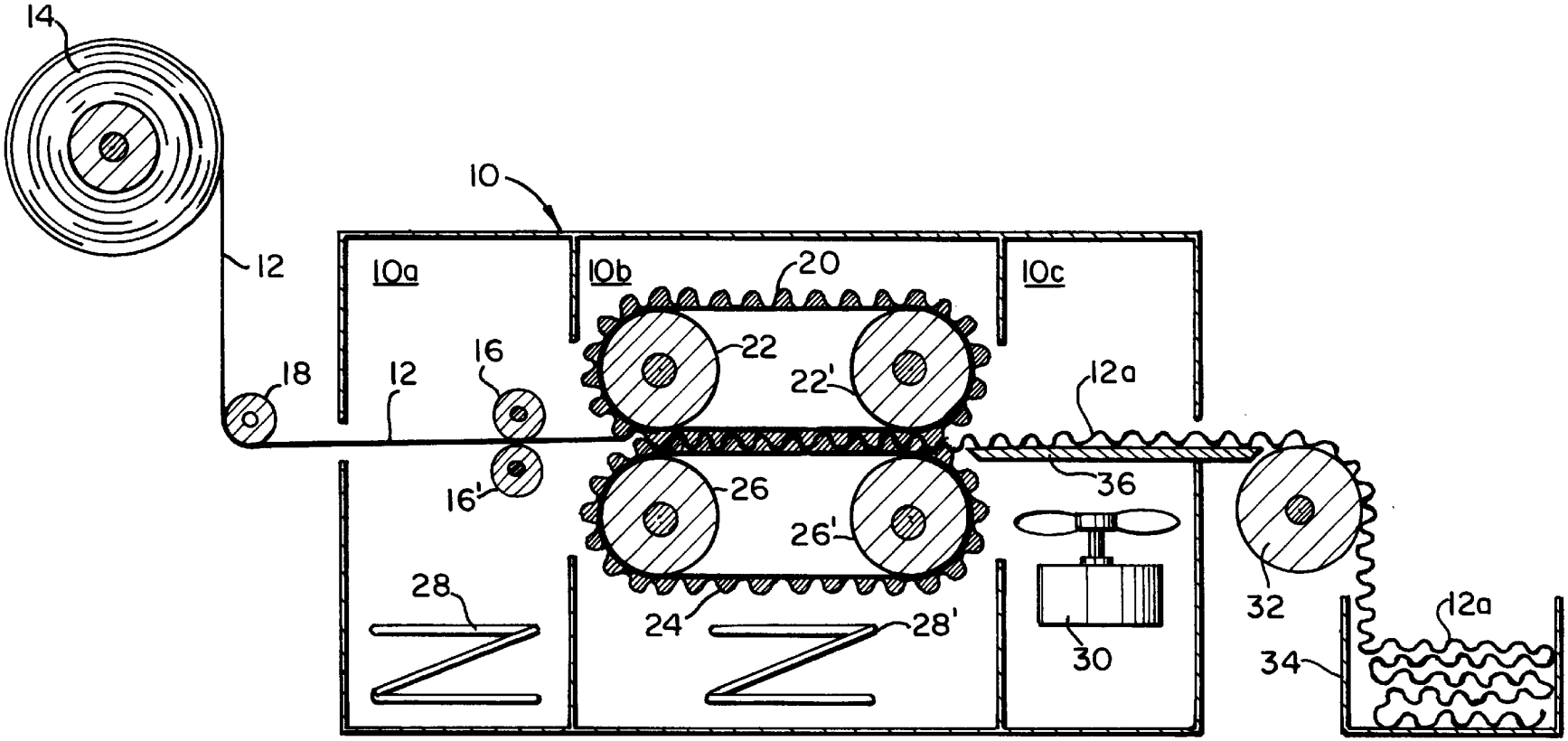
FIG. 1 is a simplified side elevational view of the apparatus of the invention.

Although specific terms are used in the following description for the sake of clarity, these terms are intended to refer only to the particular structure of the invention selected for illustration in the drawings, and are not intended to define or limit the scope of the invention.

As seen in FIG. 1 the apparatus of the invention 10 can comprise three chambers 10*a,* 10*b,* 10*c* for heating and/or cooling. For example, there is a heating chamber 10*a* with a heater 28 for preheating. There is also a chamber 10*b* with heater 28' and a chamber 10*c* with a cooling fan 30. Within chamber 10*b* is a crimping means comprising a pair of horizontally positioned endless belts with one being an upper belt having protrusions 20 and trained around wheels 22,22'. The other being a lower belt having protrusions 24 matingly engaging belt 20 between protrusions and trained around wheels 26,26'. The protrusions are rounded, indexed and spaced so as to mate and provide crimps to a fiber or tow passing therebetween. A supply roll 14 delivers a fiber or tow 12 around a roll 18 into chamber 10*a* and through pinch rolls 16,16' into chamber 10*b*. Depending upon the final product desired, chamber 10*a* can be provided with an oxidizing atmosphere or an inert atmosphere. The crimped fiber or tow 12*a* then enters chamber 10*c* where it is cooled by a fan 30 and delivered onto a conveyor 36 and around wheel 32 into a container 34.

In one operation of the apparatus, if an oxidized polyacrylonitrile fiber or tow is desired, the fiber or tow can be optionally preheated in an oxidizing atmosphere in chamber 10*a* and passed into an oxidizing and heated chamber 10*b* wherein a temporary crimp is set continuously as it passes through the chamber 10*b*. The fiber is then cooled in chamber 10*c* and delivered into the container 34.

In another operation of the apparatus, if a carbonaceous product is desired, an oxidized or stabilized fiber or tow, for example, oxidized polyacrylonitrile, is preheated in chamber 10*a* in an inert atmosphere, for example, a nitrogen atmosphere and passed through chamber 10*b* in a nitrogen atmosphere at a temperature and selected period of time to increase the carbon content of the fiber or tow to the desired amount. As the fiber or tow passes through heated chamber 10*b,* it is continuously held between the protrusions whereby it shrinks and stretches simultaneously so as to result in a fiber diameter smaller than obtained by prior art methods. The continuous grip by the crimping means as the fiber slowly carbonizes avoids the pitting which can occur by flash carbonization under stress. The fiber when cooled in chamber 10*c* passes for collection in container 34.

The apparatus with a multiplicity of chambers can also be used to deliver an acrylic fiber into an oxidizing chamber and then proceed so as to be crimped and carbonized in an inert atmosphere in a continuous process.

Figure 2:
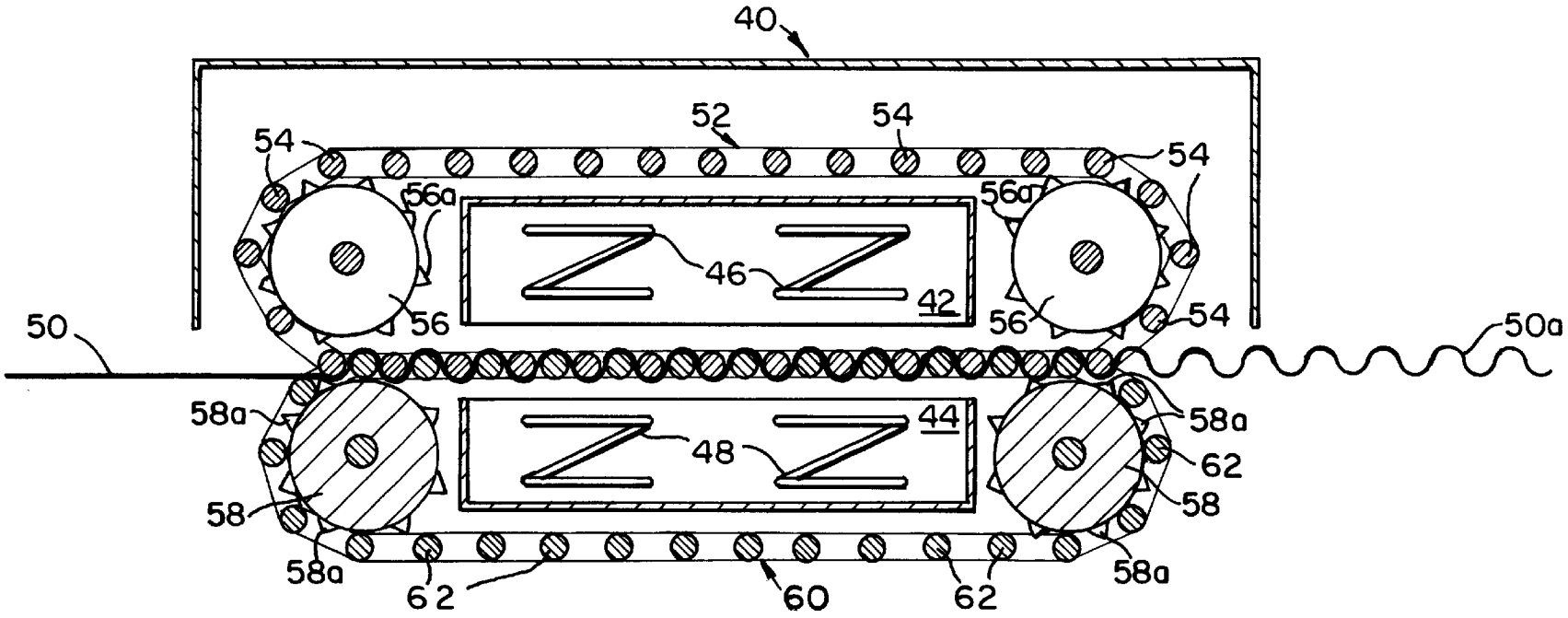
FIG. 2 is a side elevational view of the apparatus of the invention wherein the heaters are above and below the filament or tow.

FIG. 2 illustrates another embodiment of the invention wherein the apparatus is provided with a heating chamber 40. Within chamber 40 there is an endless belt 52 which travels around a pair of wheels 56 having indexing spokes 56*a*. The belt carries a multiplicity of bars 54. The bars 54 can be ⅛ to 1 inch or more in diameter and generally about one foot in length depending on the number of filaments or tows. The belt 52 is loosely held on the wheels 56 and the bars 54 have a degree of play and can be substituted or replaced. An endless belt 60 is below belt 52 which is tightly wound about wheels 58 with indexing spokes 58*a*. The belts are in a mating relationship whereby bars 54 become positioned between a pair of bars 62 on belt 60 without fine adjustment because of the play in positioning the bars 54. Accordingly, a fiber or tow 50 which is passed between the bars 54,62 are held in place by weight of gravity from bars 54 which are sitting loosely and bars 62. Since belt 52 is loose and bars 54 have play they can be easily indexed so as to ride between bars 62 on belt 60. Heating means 46 is provided in space 42 within belt 52 and heating means 48 is provided in space 44 between belt 60 so as to heat and carbonize the fiber or tow 50. The fiber or tow 50 between the bars 54,62 will carbonize, shrink in diameter and stretch into a thin fiber without substantial voids because the bars 54 are primarily gravity held and not taunt.

The bars 54 and/or 62 can be replaced with bars of different sizes and shapes so as to provide a variety of crimp shapes and fineness of crimp.

The wheels and conveying means can be synchronized by means common in the art so as to avoid any excessive stresses or strains while conveying the fibers or tows.

Polymeric precursor materials such as acrylic filaments which are advantageously utilized in preparing the carbonaceous fibers of the invention are selected from one or more of the following: acrylonitrile based homopolymers, acrylonitrile based copolymers an acrylonitrile based terpolymers. The copolymers preferably contain at least about 85 mole percent of acrylonitrile units and up to 15 mole percent of one or more monovinyl units.

Examples of other vinyl monomers copolymerizable with acrylonitrile include methacrylic acid esters and acrylic acid esters such as methyl methacrylate, ethyl methacrylate, propyl methacrylate, butyl methacrylate, methyl acrylate and ethyl acrylate; vinyl esters such as vinyl acetate and vinyl propionate; acrylic acid, methvinyl acid, maleic acid, itaconic acid and the salts thereof; and vinylsulfonic acid and the salts thereof.

The polyacrylonitrile (PAN) based fibers can be formed by conventional methods such as by melt, dry or wet spinning a suitable liquid of the precursor material. The polyacrylonitrile (PAN) based fibers which have a normal nominal diameter of from 6 to 25 micrometers are collected as an assembly of a multiplicity of continuous filaments in tows. The fibers may then be stabilized, for example by oxidation, or any other conventional method of stabilization. These stabilized fibers typically have an elongatability of from about 15 to about 25% . The stabilized fibers or tows, may then be crimped and thereafter heat treated according to the present invention while held between two endless belts with interlocking protrusions, at elevated temperatures in an inert non-oxidizing atmosphere for a period of time to produce a heat induced thermoset reaction to form carbonaceous fibers. A nitrogen content of from about 5 to about 35% is maintained when a non-graphitic fiber is desired.

The fibers of this invention can be used in substantially any desired fabricated form. The carbonaceous fibers can be stretch broken and formed by conventional equipment into roving, cord, rope or spun yarn. The spun yarn can be manufactured into woven or knitted cloth, carpets, blankets, and the like. Nonwoven structures can be manufactured into a wool like fluff or batting, sheeting, panel, paper, and the like. A wool like fluff or batting is particularly useful as a thermal insulating material.

The carbonaceous fibers of the invention can be used alone or blended with other synthetic or natural fibers. Examples of other fibers that can be used include linear and nonlinear fibers selected from natural or polymeric fibers, other carbon fibers, ceramic fibers, glass fibers, or metal or metal coated fibers. In particular, natural and/or synthetic polymeric fibers that are well adapted to be included into blends with the carbonaceous fibers of the invention are cotton, wool, polyester, polyolefin, acrylic, nylon, rayon, tetrafluoroethylene, polyamide, vinyl and protein fibers. Other mineral fibers that can be blended with the carbonaceous fibers of the invention include fibers of silica, silica alumina, potassium titanate, silicon carbide, silicon nitride, boron nitride, boron, and oxide fibers derived from boron, thoria or zirconia.

Exemplary of the present invention is the following example:

EXAMPLE 240K tow of oxidized polyacrylonitrile based precursor fibers, sold under the name PANOX by R.K. Carbon Fibres, Ltd., Muir of Ord, Scotland, U.K., and having a density of from 1.35 to 1.39 g/cc (gram per cubic centimeter) and containing at least 85 mole percentage of acrylonitrile units, is passed through a crimp forming device according to FIG. 2 having ⅛ inch bars to provide the tow with 8 crimps per inch. The crimp forming device comprises, as one component, a pair of floating, crimping round bars which form the crimp.

The tow is simultaneously crimped and passed through a heated furnace maintained at a temperature of 600° C. The furnace is constantly purged with nitrogen in accordance with the procedure described in U.S. Pat. No. 4,857,394. The residence time in the furnace is 1.5 minutes. A tow is produced having partially carbonized fibers. The fibers are suitable for use in aircraft insulation.

What is claimed is:

1. In an apparatus for crimping and heat setting a filament or a tow of filaments of acrylic or heat stabilized fibers which contains at least one heating zone with means for heating said filament or tow of filaments in an oxidizing or inert atmosphere while passing therethrough, the improvement which comprises said heating zone having an upper endless belt having a multiplicity of self indexing bars and a lower endless belt mating with said upper endless belt and having a multiplicity of spaced stationary bars for conveying and imparting crimps to said filament or tow while passing through said heating zone, said bars on said upper endless belt having a degree of play so that they are positioned by gravity between the bars on said lower endless belt.

2. The apparatus of claim 1 including a cooling zone for cooling said filament or tow after crimping.

3. The apparatus of claim 1 including a preheating zone.

4. The apparatus of claim 1 wherein said bars are replaceable.

5. The apparatus of claim 1 wherein said bars are of uniform dimension and so that a symmetrical crimp is provided.

6. The apparatus of claim 1 wherein said bars are non-symmetrical with each other so that a non-symmetrical crimp is provided.

7. The apparatus of claim 1 including means for supplying a fiber or tow between said mating conveying means.

8. The apparatus of claim 1 wherein one of said conveying means is on top of the other and each protrusion mating with the lower conveying means sits by way of gravity on the lower conveying means so as to provide a crimp to a filament or tow.

9. The apparatus of claim 8 wherein said lower conveying means is taunt.

10. The apparatus of claim 1 wherein heating means is provided for the lower and upper portion of said filament or tow.

* * * * *